US006466762B1

(12) United States Patent
Walgrove, III et al.

(10) Patent No.: US 6,466,762 B1
(45) Date of Patent: Oct. 15, 2002

(54) METHOD AND APPARATUS FOR LOCKING ELEMENTS ABOUT A GIMBAL AXIS

(75) Inventors: George R. Walgrove, III, Rochester; Gary B. Bertram, Honeoye Falls; Daniel R. Palmer, Rochester, all of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/793,072

(22) Filed: Feb. 26, 2001

(51) Int. Cl.[7] ..... G03G 15/20
(52) U.S. Cl. ..... 399/313
(58) Field of Search ..... 399/101, 121, 399/165, 288, 313, 327

(56) References Cited

U.S. PATENT DOCUMENTS 3,974,952 A * 8/1976 Swanke et al. ..... 399/288 X
5,101,238 A * 3/1992 Creveling et al. ..... 399/101
5,491,544 A * 2/1996 Kenin et al. ..... 399/121
6,097,913 A 8/2000 Bertram et al. ..... 399/121
6,195,518 B1 * 2/2001 Bennett et al. ..... 399/165
6,278,860 B1 * 8/2001 Morganti et al. ..... 399/327

* cited by examiner

*Primary Examiner*—Fred L Braun
(74) *Attorney, Agent, or Firm*—Thomas R. Fitzgerald, Esq.

(57) ABSTRACT

The invention relates in general to a method and apparatus for locking one element to another with a gimbal lock without castoring about a gimbal axis. In one preferred embodiment, a mounting apparatus and method for a roller transfer assembly for use in a reproduction apparatus are provided that accurately positions the roller transfer assembly in operative relation with a dielectric member of a reproduction apparatus with an anti-castor gimbal locking coupling.

24 Claims, 6 Drawing Sheets

METHOD AND APPARATUS FOR LOCKING ELEMENTS ABOUT A GIMBAL AXIS

BACKGROUND OF THE INVENTION

This invention relates in general to a transfer assembly for use in a reproduction apparatus, and more specifically to a mounting mechanism for a roller transfer assembly that accurately positions the roller transfer assembly in operative relation with a dielectric member of a reproduction apparatus with an anti-castor gimbal locking coupling.

In reproduction apparatuses, such as copier/duplicators or printers, a latent image charge pattern is formed on a uniformly charged dielectric member. Pigmented marking particles are attracted to the latent image charge pattern to develop the latent image on the dielectric member. The dielectric member is then brought into contact with a receiver member, and an electric field is applied to transfer the developed image to the receiver member from the dielectric member. After transfer, the receiver member bearing the transferred image is transported away from the dielectric member and the image is fixed to the receiver member by heat or pressure or both to form a permanent reproduction thereon.

The electric field is generated by ion emission from a corona charger onto the receiver member while in contact with the dielectric member, or by an electrically biased roller that urges the receiver member against the dielectric member. A roller transfer apparatus has certain advantages over a corona transfer apparatus. The roller transfer apparatus substantially eliminates defects in the transferred image due to paper cockle or marking particle flakes. Those defects occur when a pressure roller urges the receiver member against the dielectric member. However, roller transfer apparatuses are more complex than corona transfer apparatus. Roller apparatuses require cleaning due to their tendency to pick up marking particles from the dielectric member and undesirably deposit such particles on the back side of the receiver member. Further, the roller transfer apparatus, including the cleaning assemblies must be constructed so as not to interfere with ready clearance of any jammed receiver members. An example of a selectively positionable roller transfer apparatus constructed to include a cleaning mechanism is shown in U.S. Pat. No. 5,101,238 (issued 1992, in the names of Creveling, et al).

While roller transfer apparatuses are generally effective in transferring images comprising particles, they tend to impose undesirable tracking effects on the dielectric member, particularly when the dielectric member is in the form of an elongated web. U.S. Pat. No, 5,491,544 (issued Feb. 13, 1996, in the names of Kenin et al) shows a transfer assembly, of compact configuration, for a reproduction apparatus. The transfer assembly includes a transfer roller for transferring of a pigmented marking particle image from an elongated web dielectric member to a receiver member. A mechanism for mounting the roller transfer assembly includes a support for the transfer assembly connected to the transfer assembly such that the transfer roller of the transfer assembly is castored and gimbaled, However, this mechanism relies on the weight of the transfer assembly to establish the proper engagement with an unsupported span of the dielectric member. The weight of the transfer assembly can be controlled to position the transfer assembly as shown and described in U.S. Pat. No. 6,097,913, whose entire disclosure is hereby incorporated by reference. However, even with the improvement made by the latter invention, the transfer assembly may castor about its gimbal axis when the gimbal lock is tightened.

SUMMARY OF THE INVENTION

This invention is directed to a mechanism for mounting a transfer assembly in a reproduction apparatus and locking the transfer assembly at a chosen position about the gimbal axis without castoring the transfer assembly. The reproduction apparatus has a first or mounting bracket that is fixed or part of the machine housing. A second or transfer bracket holds and supports the transfer assembly. The transfer assembly includes an electrically biased transfer roller for transferring pigmented marking particle images from a dielectric member to receiver members. The transfer assembly is castored and gimbaled. An anti-castor coupling locks the mounting bracket to the transfer assembly. The anti-castor coupling is a third bracket with a pair of arms oriented at 90 degrees or more with respect to each other. The upper arm of the third bracket has a threaded opening for receiving a gimbal locking screw. The lower arm has two or more slots. Lock screws pass through the slots and engage threaded openings in the second or transfer bracket. The third bracket is slid to bring the upper arm of the third bracket into contact with the first bracket. Then the third bracket is fixedly secured to the second bracket. The transfer assembly is moved about its gimbal axis to its desired position. Once the transfer assembly is in its desired position, the gimbal lock is firmly tightened to lock the gimbal axis without castoring the transfer assembly. The third bracket keeps a gap between the transfer bracket and the mounting bracket. The third or anti-castoring bracket or at least its upper arm that connects it to the mounting bracket is relatively thin compared to the mounting bracket. The physical formation of the third or anti-castoring bracket renders it less stiff or more deformable than the mounting bracket. When the gimbal lock screw is tightened to draw the coupling bracket to the bracket, the coupling bracket deforms and thus absorbs the castoring torque generated by the gimbal lock screw.

The invention overcomes the disadvantages of the prior art. It adds a third bracket, but the cost of the added bracket is small compared to the improved performance of the transfer assembly. With the added third bracket the transfer assembly remains in its desired position after the gimbal lock is set. The invention will be become more apparent in the detailed description below when read in conjunction with the drawings.

DESCRIPTION OF THE PREFERRED EMBODIMENT

Figure 1:
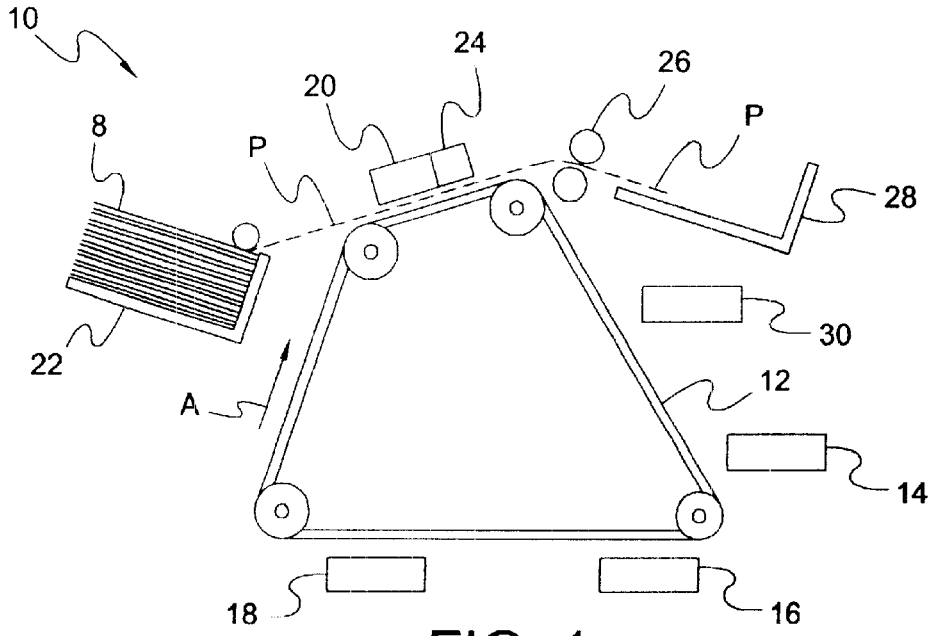
FIG. 1 is a schematic illustration of a typical reproduction apparatus suitable for utilizing the roller transfer assembly positioning mechanism according to this invention.

Referring now to the accompanying drawings, FIG. 1 schematically illustrates a typical reproduction apparatus 10, of the electrophotographic type, suitable for utilizing an exemplary roller transfer assembly such as shown and described in aforementioned U.S. Pat. No. 6,097,913. The reproduction apparatus 10, described herein only to the extent necessary for a complete understanding of this invention, includes a dielectric member 12. The dielectric member 12 is, for example, in the form of an elongated endless web mounted on support rollers and movable about a closed loop path through a series of electro graphic process stations in the direction of the arrow A.

In the reproduction cycle for the reproduction apparatus 10, the moving dielectric member 12 is uniformly charged as it moves past a charging station 14. Thereafter the uniformly charged dielectric member passes through an exposure station 16 where the uniform charge is altered to form a latent image charge pattern corresponding to information desired to be reproduced. Depending upon the characteristics of the dielectric member and the overall reproduction system, formation of the latent image charge pattern may be accomplished by exposing the dielectric member to a reflected light image of an original document to be reproduced or "writing" on the dielectric member with a series of lamps (e.g., LED's or lasers) or point electrodes activated by electronically generated signals based on the desired information to be reproduced. The latent image charge pattern on the dielectric member 12 is then brought into association with a development station 18 which applies pigmented marking particles to adhere to the dielectric member to develop the latent image. The portion of the dielectric member carrying the developed image then passes through a transfer station 20 in register with a receiver member 8 fed in proper timed relation from a supply hopper 22 along the path P. An electric field produced in the transfer station attracts the marking particle of the developed image from the dielectric member to the receiver member.

The electric transfer field may also cause the receiver member 8 to adhere to the dielectric member. Accordingly, a detach mechanism 24, immediately downstream in the direction of travel of the dielectric member, is provided to facilitate removal of the receiver member from the dielectric member. The detach mechanism may be, for example, an AC corona charger for neutralizing the attractive field holding the receiver member to the dielectric member. After the developed image is transferred to the receiver member and the receiver member is separated from the dielectric member, the receiver member is transported through a fusing device 26 where the image is fixed to the receiver member by heat and/or pressure for example, and delivered to an output hopper 28 for operator retrieval. Simultaneously, the dielectric member 12 is cleaned of any residual marking particles at cleaning station 30 and returned to the charging station 14 for reuse.

Figure 2:
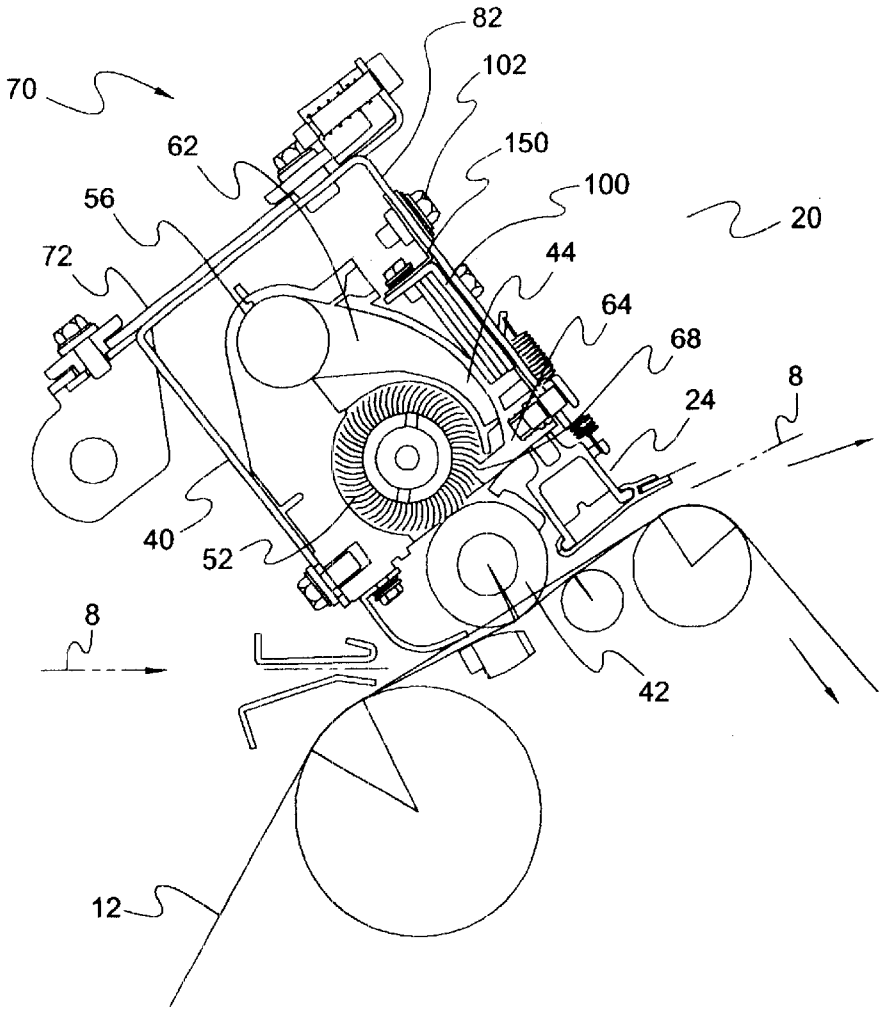
FIG. 2 is a cross-section view of a roller transfer assembly including the anti-castoring and positioning mechanism according to this invention.

Turning now to the exemplary transfer station 20, as noted above such station is for example a roller transfer assembly which is described herein below with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detach mechanism 24 in a compact configuration. An electrical bias is applied to the core of the roller 42 from a voltage limited constant current power supply (not shown). As such, when the transfer roller is in operative association with the dielectric member 12 (as shown in FIG. 2), an electrical transfer field is established which will efficiently transfer a marking particle developed image from the dielectric member to a receiver member passing there between.

When the transfer roller 42 contacts the dielectric member 12 with no receiver member 8 there between, the transfer roller tends to pick up residual marking particles from the dielectric member. On subsequent passes of receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62. The vacuum air flow system 62, in flow communication with a vacuum blower (not shown), forms an air flow directing chamber about the brush 52. The air flow chamber provides an air flow passage wrapping about a portion of the brush 52 with an opening 64 to the brush adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The detach mechanism 24 of the roller transfer assembly is preferably an AC corona charger interconnected with the unitary housing 40. The detach mechanism 24 is located such that when the roller transfer assembly 20 is in operative association with the dielectric member 12, the detach charger is located downstream (in the direction of dielectric member travel) from the transfer roller 42 to effectively provide a field which relieves the electrostatic attraction forces between the receiver member and the dielectric member. In this manner, the receiver member is readily detached from the dielectric member for transport along its intended path P to the fusing device 26 (FIG. 1) without interference or jamming.

Figure 3:
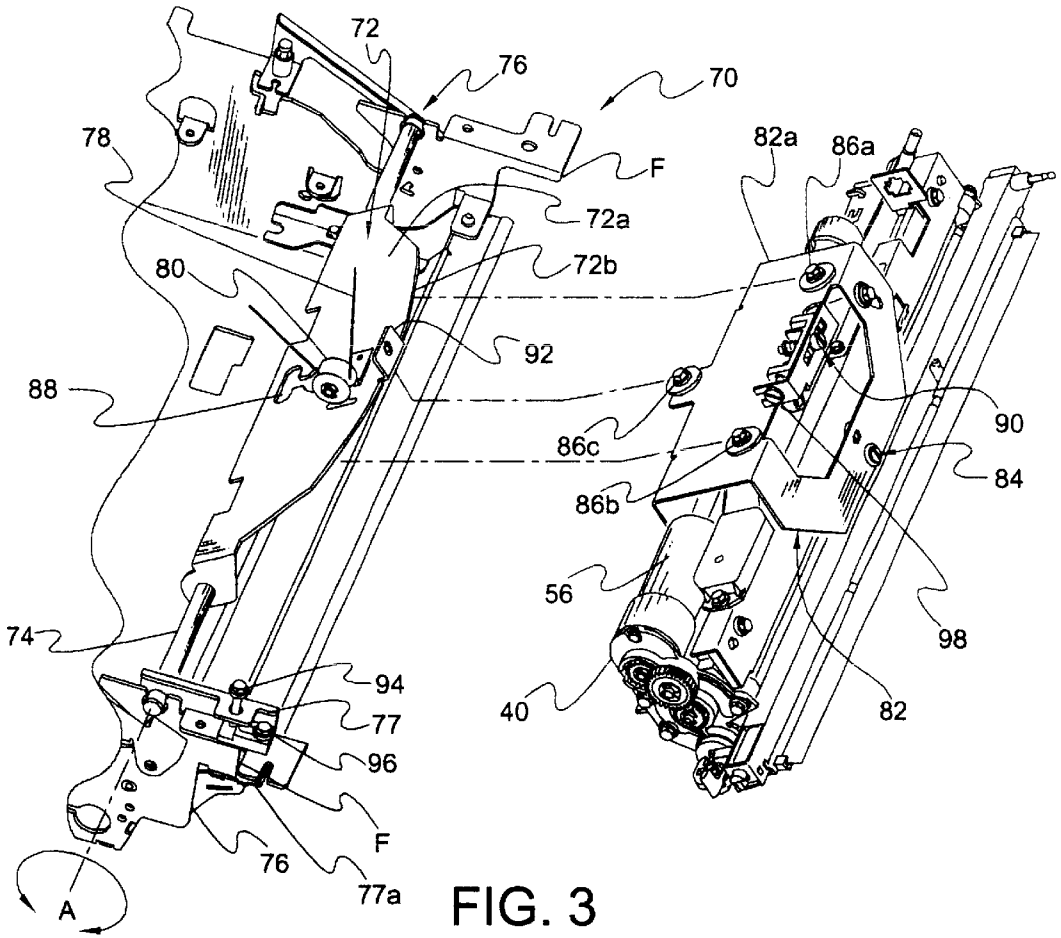
FIG. 3 is an exploded view, in perspective, of the roller transfer assembly including the transfer roller positioning mechanism of FIG. 2, with portions removed to facilitate viewing.
Figure 4:
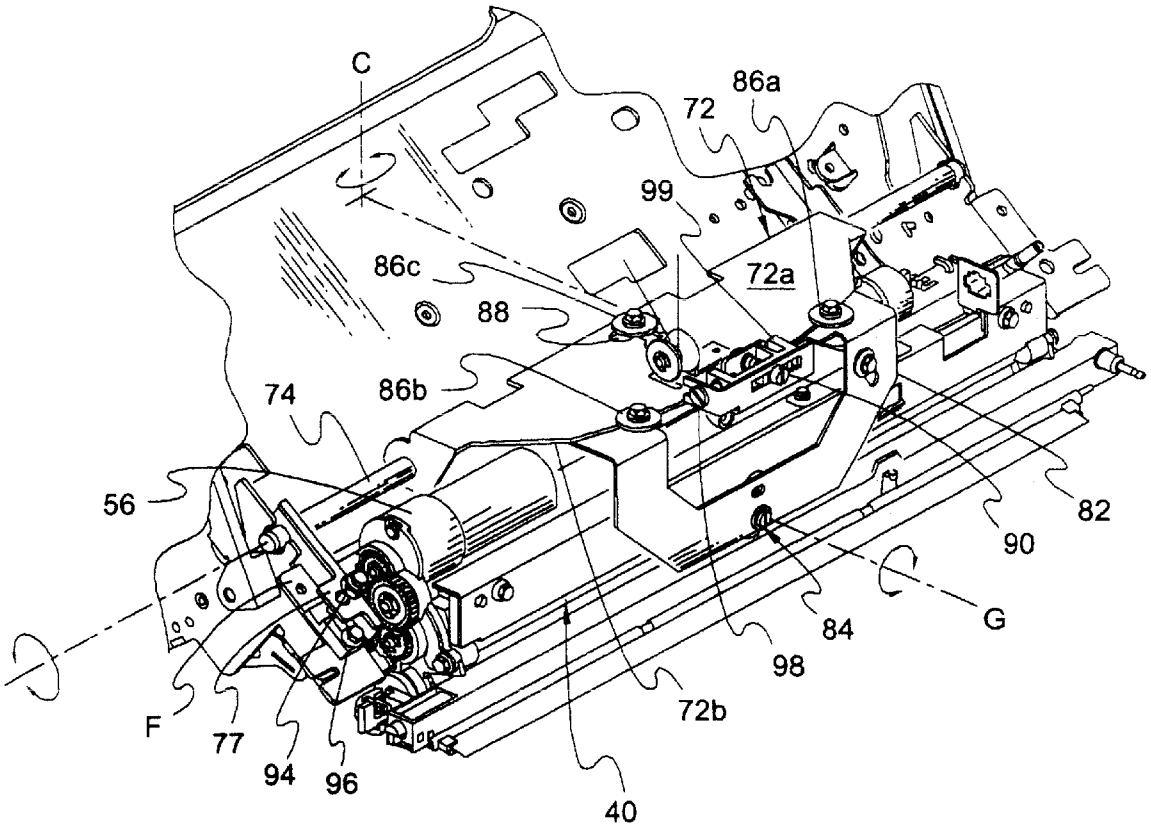
FIG. 4 is a view, in perspective, of the roller transfer assembly including the transfer roller positioning mechanism of FIG. 2, with portions removed to facilitate viewing.

With the compact arrangement for the roller transfer assembly described above, a mounting, designated generally by the numeral 70, is provided according to this invention. The mounting 70 enables the roller transfer assembly to contact the dielectric member 12 in a manner so as to impart no steering forces to the moving support. As shown in FIGS. 2–4, the mounting 70 for the roller transfer assembly includes a tie bar weldment 72 that is permanently mounted in the machine frame F of the reproduction apparatus 10. The tie bar weldment 72 includes a plate member 72*a* fixed to a shaft 74. The shaft, in turn, rests in bushings 76 on the machine frame F. As such, the tie bar weldment 72 is free to rotate about the longitudinal axis of the shaft 74. A cable assembly 78 is attached to a pulley 80 mounted on the tie bar weldment plate member 72*a*. The cable assembly 78 serves to urge the tie bar weldment plate member 72*a* for rotation about the axis of the shaft 74 (in a substantially clockwise direction in FIG. 3) when components (not shown) in the receiver member travel path are lifted, for example for the purpose of jam clearance.

The unitary housing 40 of the roller transfer assembly has a substantially U-shaped machine mounting bracket 82 fixed to the housing by a pivot assembly 84, more fully described below. The base member 82*a* of the bracket 82 supports three flanged bushings 86*a*, 86*b*, and 86*c*. When the bracket 82 is assembled with the tie bar weldment 72, the flanged bushings 86*a* and 86*b* ride against a curved lead edge 72*b* of the tie bar weldment plate member 72*a*, while bushing 86*c* is received through a keyhole slot 88 defined in the plate member. A captive spring loaded locking screw 90 secures the bracket 82, and thus the roller transfer assembly housing 40, to an upstanding tab 92 of the tie bar weldment plate member 72*a*.

Two adjusting screws 94 and 96 are provided to establish the limits of rotation of the tie bar weldment plate member 72*a* about the longitudinal axis of the shaft 74. An arm 77 is fixed to the shaft 74 for rotation therewith, and extends substantially radially therefrom. The adjusting screw 94, as best shown in FIG. 3, extends through the arm 77 a predetermined adjustable distance. As such, the limiting end of the screw 94 is engaged with a portion of the frame F of the reproduction apparatus to limit rotation in one direction (in the clockwise direction of FIG. 3) for the tie bar weldment plate member 72*a*. The limit position for the plate member is predetermined so as to set the engagement of the transfer roller 42 with the dielectric member 12 in order to establish proper operative relation there between.

The adjusting screw 96, as shown in FIGS. 3 or 4, extends through the portion of the frame F, adjacent to the point of contact of the screw 94, a predetermined adjustable distance. As such, the limiting end of the screw 96 is engaged with a portion 77*a* extending from the arm 77 to limit rotation in the opposite direction (in the clockwise direction of FIG. 3) for the tie bar weldment plate member 72*a*. The limit position for the plate member is predetermined so as to set the disengagement of the transfer roller 42 from the dielectric member 12 in order to establish sufficient clearance available between the roller transfer assembly and the dielectric member 12 for clearing a receiver member jam. After lifting the tie bar weldment plate member 72*a* (and the attached roller transfer assembly) for clearing a jam or replacing the roller transfer assembly after servicing, the weight of the roller transfer assembly, bracket 82 and tie bar weldment 72 is sufficient to assure that the adjusting screw 94 returns into engagement with the frame F so that the transfer roller 42 properly reengages the dielectric member 12 in operative relation therewith.

In order that the transfer roller 42 properly tracks with the dielectric member 12, the roller transfer assembly housing 40 is enabled by the mechanism 70 to castor about a castor axis C (see FIG. 4). As seen in FIGS. 3 and 4, a lead screw 98 selectively moves an adjusting block 99 attached to the bracket 82. The movement of the adjusting block 99 by the adjusting lead screw 98 causes the flanged bushings 86*a*, 86*b* on the bracket 82 to follow the curved surface 72*b* of the tie bar weldment 72. The curved surface 72*b* is selected to have a radius of curvature substantially equal to the distance between the curved surface and the castor axis C. As such, the bracket 82 will properly rotate about the castor axis C. When the bracket 82 is properly located about the castor axis C relative to the tie bar weldment 72, the captive locking screw 90 may be tightened to maintain the bracket and weldment in the desired relative position. Locking out the castor motion ensures that external forces, for example from attached air hoses and electrical cables (not shown) do not influence the position of the transfer roller 42 to compromise dielectric member tracking. Of course, according to this invention, active castoring could be provided during the running of a reproduction job.

The roller transfer assembly, in the bracket 82, is also enabled to rotate about the gimbal axis G (see FIG. 4). A pivot pin assembly 84 carried by the bracket 82, and connected to the roller transfer assembly housing 40. The longitudinal axis of the pivot pin assembly is coincident with the gimbal axis G. As such, the roller transfer assembly housing 40 is rotatable, in the bracket 82, about the pivot pin assembly 84, and thus about the gimbal axis G. When the roller transfer assembly housing 40 is properly located about the gimbal axis G relative to the bracket 82, a locking screw 102 may be tightened to maintain the housing and the bracket in the desired relative position.

Figure 5:
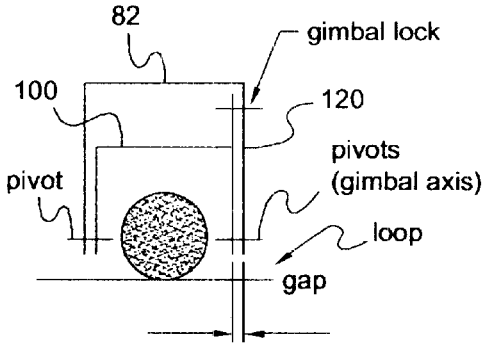
FIG. 5 (PRIOR ART)
FIG. 5 is a mechanical schematic view of a conventional bracket configuration.

However, in prior art devices (FIG. 5) the action of turning the locking screw 102 generates a torque that castors the transfer assembly about the gimbal axis. FIG. 5 is a mechanical schematic view. It shows the outer fixed mounting bracket 82, the inner transfer assembly support bracket 100 with an integral vertical arm 120. The transfer assembly components are not shown in order to emphasize the relationship and mutual interaction of brackets 82, 100 and the arm 120. The gimbal locking screw extends through an opening in the outer fixed mounting bracket 82 and threads into a corresponding threaded opening in an upper arm of the angle bracket 120. Recall that the gimbal lock 102 is offset from the center line of brackets 82, 100. See FIG. 4. The entire transfer bracket 100 is urged against the mounting bracket 82. Then the transfer assembly is castored into its desired position with respect the dielectric member 12. When the gimbal lock is tightened, any remaining gap is closed and the lock screw generates a torque between brackets 82, 100. That torque causes the transfer assembly to castor about the gimbal axis G. As such, the transfer roller 42 becomes misaligned with respect to the dielectric member 12.

Figure 6:
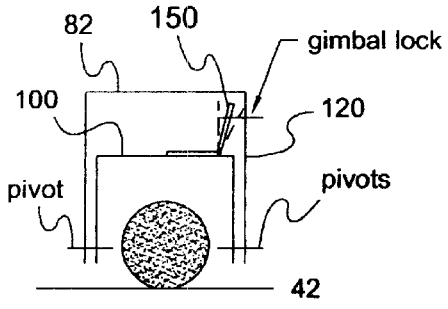
FIG. 6 is a mechanical schematic view of the bracket configuration of the invention.
Figure 7:
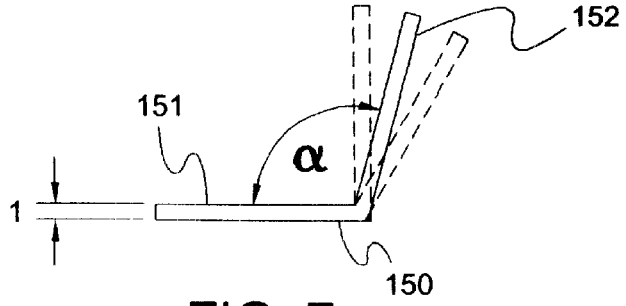
FIG. 7 is an elevation view of the obtuse angle bracket.

The anti-castoring coupling bracket of the invention (FIG. 6 and FIG. 7) solves the problem and does not castor the transfer assembly about the gimbal axis. The arm 120 is removed from the transfer bracket 100 and is replaced by a separate angled bracket 150. We discovered that the desire, misalignment due to the torque on the gimbal lock 102 is reduced and for all practical purposes eliminated by using a angled bracket 150. It has lower and upper alms 151, 152 that are oriented with respect to each other at 90 degrees or more. The angle may be as large as about 95 degrees. Tests show that an angle of about 92 degrees generates minimal forces. Tests also showed that the relative thickness of the angle bracket 150 and the bracket 82 are important. Our tests are summarized in Table 1 below where we show the performance in the presence of anticipated noise factors. The dB value indicates a signal to noise level. Higher levels are preferred. The tests were made with two angled brackets of different thicknesses and angles. In all cases the mounting bracket was about 0.060 inches thick. Best results were found with an angled bracket of 0.030 inches thick and oriented at an angle of about 92 degrees. We believe that when the gimbal lock is tightened, the upper aim 152 tends to deform and thereby absorb the unwanted torque generated by the gimbal lock screw 102. A summary of the tests appears below in Table 1.

TABLE 1

| Thickness (inches) | Angle (degrees) | Angle (degrees) |
|---|---|---|
| | 90 | 92 |
| 0.030 in. | 12.5 dB | 18.9 dB |
| 0.060 in. | 3.8 dB | 8.8 dB |

Based on the test results, we concluded that the invention may be used with angles of 90 degrees or higher. As a practical matter, about 95 degrees is the maximum angle for mounting transfer bracket to a machine bracket in a copier. The relative thicknesses of the mounting bracket and the angle bracket are greater than 1:1. As between the angle and the thickness, we believe that the thickness is the more important factor. It contributes about 75% of the solution and the angle differences contribute about 25%. Our tests lead us to conclude that other embodiments of the invention are also of practical value. For example, if the angled bracket was a structural member, then the mounting bracket 82 could, in theory, be thinner than the angle bracket 150. Likewise, the arm 82*b* of the outer bracket could be obtuse with respect to 82*a* and a conventional angle bracket could be used. Stated another way, the angle between the arms 151 and 82*b* is an acute angle. The materials of the two brackets 150 and 82 may be chosen so that one is relatively softer and less stiff that the other. The bracket 150 may be made of sheet metal, plastic or any other suitable material that is softer and less stiff than the material of bracket 82. The bracket 150 may have arms 151, 152 of different materials, so long as there is a relative difference in hardness or stiffness between the arm 152 and the bracket arm 82*b*. Moreover, while the invention is shown in the embodiment of a copy machine, it may be used in other applications when gimbaled and castored rollers are oriented with respect to a moving sheet or film that contacts the roller.

Figure 8:
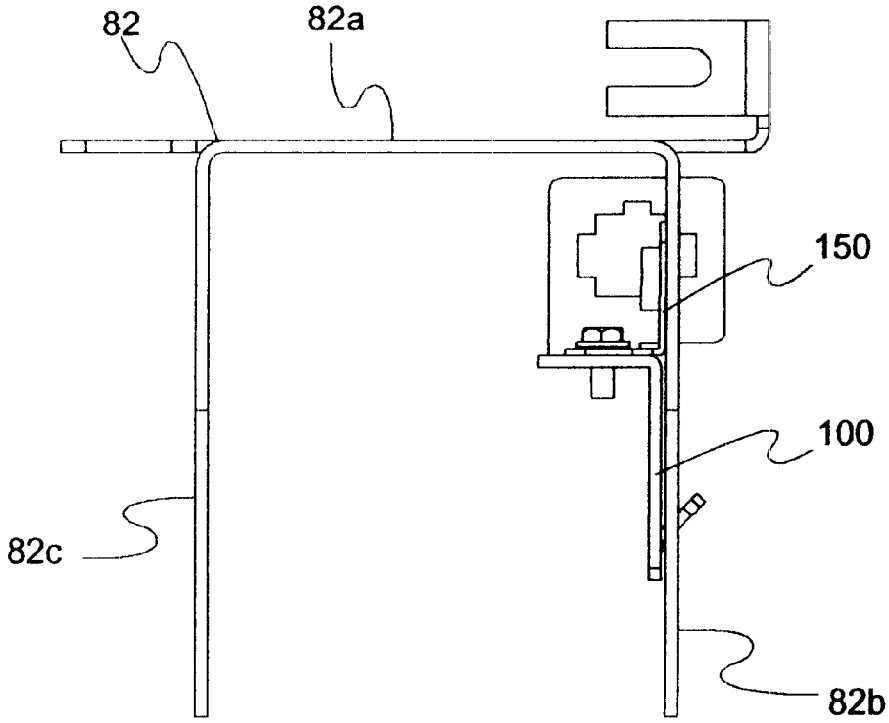
FIG. 8 is a simplified elevation view of the bracket configuration with the obtuse bracket.
Figure 9:
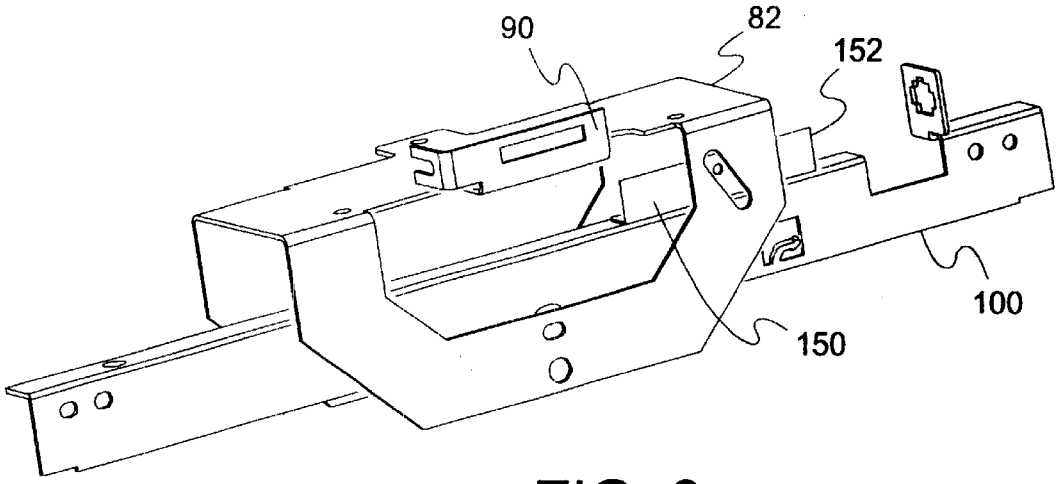
FIG. 9 is a simplified perspective view of the bracket configuration with the obtuse bracket.
Figure 10A:
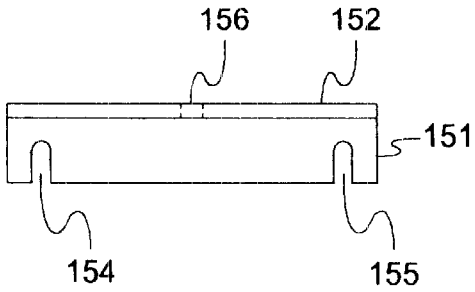
FIGS. 10*a*, 10*b* are, respectively, plan and elevation views of the obtuse angle bracket.
Figure 10B:
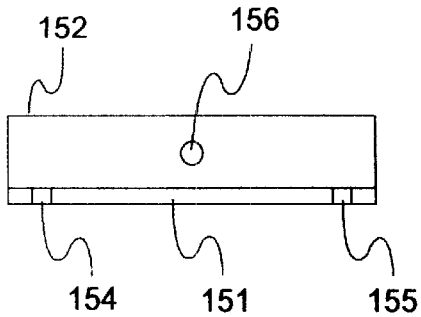

The angle bracket 150 is shown in more detail in FIGS. 10*a* and 10*b*. The lower arm 151 has slots 154 and 155 for receiving locking screws that hold the arm. The upper arm 152 has threaded opening 156 for receiving the gimbal locking screw 102. FIG. 8 shows the three brackets as assembled without the transfer assembly. FIG. 9 is a perspective view of the three brackets 82, 100, 150 as assembled, also shown without the transfer assembly. In FIG. 9 the upper arm 152 is shown transparently so that the lower arm 151 can be seen. The angle bracket 150 is slid to contact the bracket 82. Then the arm 151 is secured to the top of the bracket 100 by lock screws that are received in threaded openings in the bracket 100. The transfer assembly is allowed to gimbal freely to find its preferred operating position. Then the lock down screw 102 secures arm 82*b* to arm 152. This adjustment maintains a suitable gap between the brackets 100 and 82.

The castored and gimbaled transfer roller 42 substantially eliminates unwanted reaction forces on the dielectric member 12. Those are forces that result from conventional methods that over constrain the movement of the transfer roller. Accordingly, the quality of copies made with the invention will be both better and more consistent in that they will have fewer artifacts. Furthermore, there will be less wear on the dielectric member so as to improve its life, and the dielectric member will experience fewer tracking problems due to improper steering effects otherwise induced by the transfer roller.

The invention has been described in detail with particular reference to a preferred embodiment thereof, but it will be understood that variations and modifications can be made within the spirit and scope of the invention.

What we claim is:

1. An apparatus for locking one element to another comprising:

a first bracket fixedly mounted on a machine housing, a second bracket holding a roller assembly that is adjustably mounted about a gimbal axis;

a third bracket disposed between the first and second brackets, adjustably positioned and coupled at one end to the second bracket and the other end to the first bracket, wherein the end of the third bracket coupled to the first bracket has a stiffness relatively different from the stiffness of the first bracket;

a gimbal lock between the first and the third brackets for turning a first direction of rotation to fixedly connect the third bracket to the first bracket without castoring the second bracket about its gimbal axis.

2. The apparatus of claim 1 wherein the third bracket comprises a first arm coupled to the first bracket and a second arm coupled to the second bracket, said second arm oriented at an obtuse angle with respect to the first arm.

3. The apparatus of claim 2 wherein the obtuse angle is greater than 90 degrees and equal to or less than 95 degrees.

4. The apparatus of claim 1 wherein the end of the third bracket attached to the first bracket is thinner than the first bracket.

5. The apparatus of claim 1 wherein the end of the third bracket attached to the first bracket is as thick as or thicker than the first bracket.

6. The apparatus of claim 1 wherein the ratio of the thickness of the first bracket to the third bracket is greater than 1:1.

7. In a reproduction apparatus having a transfer assembly, including an electrically biased transfer roller for effecting transfer of pigmented marking particle images from a dielectric member to receiver members, a mechanism for mounting said transfer assembly in said reproduction apparatus and preventing unwanted castoring of the transfer assembly, said mechanism comprising:

a machine mounting bracket for supporting said transfer assembly within said reproduction apparatus;

a transfer assembly support bracket for supporting said transfer assembly, said transfer assembly support bracket for enabling adjustable movement of said transfer assembly support bracket relative to said machine mounting bracket about a castor axis, and a pivot pin assembly, coincident with a gimbal axis, engaged with said transfer assembly to enable said transfer assembly to rotate relative to said bracket about said gimbal axis;

an anti-castor coupling disposed between the transfer assembly support bracket and the machine mounting bracket for locking the transfer assembly at a chosen gimbal angle without altering the castor angle.

8. The mechanism for mounting said transfer assembly of claim 7 wherein the anti-castor coupling comprises a gimbal lock between the transfer assembly mounting bracket and the machine mounting bracket for turning a first direction of rotation to fixedly hold together the two brackets together without castoring one about the other.

9. The mechanism of claim 7 wherein anti-castor coupling comprises a first arm coupled to the transfer assembly mounting bracket and a second arm coupled to the machine mounting bracket, said second arm oriented at 90 degrees or more with respect to the first arm.

10. The mechanism of claim 9 wherein the angle is greater than 90 degrees and equal to or less than 95 degrees.

11. The apparatus of claim 7 wherein at least one of the anti-castor coupling and the machine mounting bracket have different thicknesses.

12. The apparatus of claim 7 wherein the anti-castor coupling is thinner than the machine mounting bracket.

13. A method for joining a second bracket mounted on a gimbal axis to a first, fixed bracket without castoring the second bracket about the gimbal axis comprising:

fixing a first bracket to a machine housing;

adjusting a second bracket with a roller assembly to a position on the gimbal axis of the second bracket;

positioning a third bracket between the first and second brackets;

coupling the third bracket at one end to the second bracket and the other end to the first bracket, wherein the end of the third bracket coupled to the first bracket has a stiffness relatively different from the stiffness of the first bracket;

locking the first and the third brackets on the gimbal axis by turning a gimbal lock in first direction of rotation to connect the third bracket to the first bracket without castoring the second bracket about its gimbal axis.

14. The method of claim 13 wherein the third bracket comprises a first arm coupled to the first bracket and a second arm coupled to the second bracket, said second arm oriented at an obtuse angle with respect to the first arm.

15. The method of claim 14 wherein the obtuse angle is greater than 90 degrees and equal to or less than 95 degrees.

16. The method of claim 13 wherein the end of the third bracket attached to the first bracket is thinner than the first bracket.

17. The method of claim 13 wherein the end of the third bracket attached to the first bracket is as thick as or thicker than the first bracket.

18. The method of claim 13 wherein the ratio of the thickness of the first bracket to the third bracket is greater than 1:1.

19. In a reproduction apparatus having a transfer assembly, including an electrically biased transfer roller for effecting transfer of pigmented marking particle images from a dielectric member to receiver members, a method for mounting said transfer assembly in said reproduction apparatus and preventing unwanted castoring of the transfer assembly, said method comprising:

providing a machine mounting bracket for supporting said transfer assembly within said reproduction apparatus;

supporting a transfer assembly including a transfer roller on a transfer assembly support bracket, adjusting the location of the transfer assembly on the transfer assembly support bracket relative to a castor axis;

locking the transfer assembly bracket to the machine bracket at a gimbal axis position and inhibiting castoring of the transfer assembly support bracket relative to the machine bracket when the transfer assembly support bracket is locked at the gimbal axis position.

20. The method for mounting said transfer assembly of claim 19 wherein castoring is inhibited by coupling a third bracket between the machine mounting bracket and the transfer assembly support bracket, said third bracket having a stiffness less than the stiffness of the machine mounting bracket.

21. The method of claim 20 wherein the third bracket comprises a first arm coupled to the transfer assembly mounting bracket and a second arm coupled to the machine mounting bracket, said second arm oriented at 90 degrees or more with respect to the first arm.

22. The method of claim 21 wherein the angle is greater than 90 degrees and equal to or less than 95 degrees.

23. The method of claim 21 wherein the third bracket and the machine mounting bracket have different thicknesses.

24. The method of claim 23 wherein the third bracket is thinner than the machine mounting bracket.

* * * * *